US007997650B2

(12) United States Patent
McMillen et al.

(10) Patent No.: US 7,997,650 B2
(45) Date of Patent: Aug. 16, 2011

(54) CONSTANT PRESSURE RETREATING LUMBAR SYSTEM

(75) Inventors: Robert J. McMillen, Tecumseh (CA); Larry D. Janzen, Harrow (CA); Alan C. Prettyman, Amherstburg (CA)

(73) Assignee: Schukra of North America, Lakeshore-Tecumseh, Ontario (CA)

( * ) Notice: Subject to any disclaimer, the term of this patent is extended or adjusted under 35 U.S.C. 154(b) by 187 days.

(21) Appl. No.: 12/390,735

(22) Filed: Feb. 23, 2009

(65) Prior Publication Data

US 2009/0212616 A1 Aug. 27, 2009

Related U.S. Application Data

(60) Provisional application No. 61/066,803, filed on Feb. 22, 2008.

(51) Int. Cl.
*A47C 7/46* (2006.01)

(52) U.S. Cl. ..... 297/284.4; 297/284.7; 297/284.8

(58) Field of Classification Search ..... 297/284.4, 297/284.7, 284.8, 284.1
See application file for complete search history.

(56) References Cited

U.S. PATENT DOCUMENTS

| | | | | |
|---|---|---|---|---|
| 855,656 | A * | 6/1907 | McNamara | 297/284.4 |
| 1,177,265 | A | 3/1916 | Pavey et al. | |
| 1,182,854 | A | 5/1916 | Poler | |
| 1,743,377 | A | 10/1927 | Nadell | |
| 2,614,615 | A | 10/1952 | Asaro | |
| 2,756,809 | A | 7/1956 | Endresen | |
| 2,835,312 | A | 5/1958 | Neely | |
| 2,843,195 | A | 7/1958 | Barvaeus | |
| 2,922,416 | A | 1/1960 | Fader | |
| 2,942,651 | A | 6/1960 | Binding | |
| 3,378,299 | A | 4/1968 | Sandor | |
| 3,490,084 | A | 1/1970 | Schuster | |
| 3,492,768 | A | 2/1970 | Schuster | |
| 3,724,144 | A | 4/1973 | Schuster | |
| 3,762,769 | A | 10/1973 | Poschl | |
| 3,880,463 | A | 4/1975 | Shephard et al. | |
| 4,019,777 | A | 4/1977 | Hayashi | |
| 4,136,577 | A | 1/1979 | Borgersen | |
| 4,148,522 | A | 4/1979 | Sakurada et al. | |
| 4,153,293 | A | 5/1979 | Sheldon | |
| 4,155,592 | A | 5/1979 | Tsuda et al. | |
| 4,156,544 | A | 5/1979 | Swenson et al. | |
| 4,162,807 | A | 7/1979 | Yoshimura | |
| 4,182,533 | A | 1/1980 | Arndt et al. | |
| 4,295,681 | A | 10/1981 | Gregory | |
| 4,296,965 | A | 10/1981 | Sakurada et al. | |
| 4,313,637 | A | 2/1982 | Barley | |
| 4,316,631 | A | 2/1982 | Lenz et al. | |
| 4,354,709 | A | 10/1982 | Schuster | |
| 4,390,210 | A | 6/1983 | Wisniewski et al. | |

(Continued)

FOREIGN PATENT DOCUMENTS

| | | |
|---|---|---|
| AT | 401497 | 9/1996 |

(Continued)

*Primary Examiner* — Laurie K Cranmer

(57) ABSTRACT

The present invention is a lumbar support system that retreats into the seat back when reclined, providing a constant pressure support. The lumbar support system has a lumbar support basket that can retreat into the seat back. The lumbar support basket is supported by a crossbar that is pivotably connected to opposite sides of a seat frame via a pair of connecting members. A spring is provided for biasing the connecting members to a biased position.

13 Claims, 11 Drawing Sheets

U.S. PATENT DOCUMENTS 4,449,751 A 5/1984 Murphy et al.
4,452,485 A 6/1984 Schuster
4,465,317 A 8/1984 Schwarz
4,494,709 A 1/1985 Takada
4,541,670 A 9/1985 Morgenstern et al.
4,555,140 A 11/1985 Nemoto
4,556,251 A 12/1985 Takagi
4,561,606 A 12/1985 Sakakibara et al.
4,564,235 A 1/1986 Hatsutta et al.
4,565,406 A 1/1986 Suzuki
4,576,410 A 3/1986 Hattori
4,601,514 A 7/1986 Meiller
4,602,819 A 7/1986 Morel
4,627,661 A 12/1986 Ronnhult et al.
4,630,865 A 12/1986 Ahs
4,632,454 A 12/1986 Naert
4,650,247 A 3/1987 Berg et al.
4,671,569 A 6/1987 Kazaoka et al.
4,676,550 A 6/1987 Neve De Mevergnies
4,679,848 A 7/1987 Spierings
4,715,653 A 12/1987 Hattori et al.
4,725,095 A 2/1988 Benson et al.
4,730,871 A 3/1988 Sheldon
4,880,271 A 11/1989 Graves
4,909,568 A 3/1990 Dal Monte
4,915,448 A 4/1990 Morgenstern
4,950,032 A 8/1990 Nagasaka
4,957,102 A 9/1990 Tan et al.
4,968,093 A 11/1990 Dal Monte
5,005,904 A 4/1991 Clemens et al.
5,007,677 A 4/1991 Ozawa et al.
5,022,709 A 6/1991 Marchino
5,026,116 A 6/1991 Dal Monte
5,050,930 A 9/1991 Schuster et al.
5,076,643 A 12/1991 Colasanti et al.
5,087,098 A 2/1992 Ishizuka
5,088,790 A 2/1992 Wainwright et al.
5,112,106 A 5/1992 Asbjornsen et al.
5,137,329 A 8/1992 Neale
5,174,526 A 12/1992 Kanigowski
5,197,780 A 3/1993 Coughlin
5,215,350 A 6/1993 Kato
5,217,278 A 6/1993 Harrison et al.
5,286,087 A 2/1994 Elton
5,299,851 A 4/1994 Lin
5,335,965 A 8/1994 Sessini
5,385,531 A 1/1995 Jover
5,397,164 A 3/1995 Schuster
5,423,593 A * 6/1995 Nagashima ..... 297/284.4
5,449,219 A 9/1995 Hay et al.
5,452,868 A 9/1995 Kanigowski
5,468,048 A 11/1995 Clemens et al.
5,474,358 A 12/1995 Maeyaert
5,498,063 A 3/1996 Schuster et al.
5,505,520 A 4/1996 Frusti et al.
5,518,294 A 5/1996 Ligon, Sr. et al.
5,553,917 A 9/1996 Adat et al.
5,562,324 A 10/1996 Massara et al.
5,567,010 A 10/1996 Sparks
5,567,011 A 10/1996 Sessini
5,588,703 A 12/1996 Itou
5,609,394 A 3/1997 Ligon, Sr. et al.
5,626,390 A 5/1997 Schuster et al.
5,638,722 A 6/1997 Klingler
5,651,583 A 7/1997 Klingler et al.
5,651,584 A 7/1997 Chenot et al.
5,704,687 A 1/1998 Klingler
5,716,098 A 2/1998 Lance
5,718,476 A 2/1998 De Pascal et al.
5,758,925 A 6/1998 Schrewe et al.
5,762,397 A 6/1998 Venuto et al.
5,769,491 A 6/1998 Schwarzbich
5,772,281 A 6/1998 Massara
5,775,773 A 7/1998 Schuster et al.
5,791,733 A 8/1998 Van Hekken et al.
5,816,653 A 10/1998 Benson
5,823,620 A 10/1998 Le Caz
5,857,743 A 1/1999 Ligon, Sr. et al.
5,868,466 A 2/1999 Massara et al.
5,884,968 A 3/1999 Massara
5,897,168 A 4/1999 Bartelt et al.
5,911,477 A 6/1999 Mundell et al.
5,913,569 A 6/1999 Klingler
5,934,752 A 8/1999 Klingler
5,947,558 A * 9/1999 Suzuki et al. ..... 297/284.4
5,954,399 A * 9/1999 Hong ..... 297/284.4
5,975,632 A 11/1999 Ginat
5,984,407 A 11/1999 Ligon, Sr. et al.
5,988,745 A 11/1999 Deceuninck
6,003,941 A 12/1999 Schuster, Sr. et al.
6,007,151 A 12/1999 Benson
6,030,041 A 2/2000 Hsiao
6,036,265 A 3/2000 Cosentino
6,045,185 A 4/2000 Ligon, Sr. et al.
6,050,641 A 4/2000 Benson
6,053,064 A 4/2000 Gowing et al.
6,079,783 A 6/2000 Schuster, Sr. et al.
6,089,664 A 7/2000 Yoshida
6,092,871 A 7/2000 Beaulieu
6,129,419 A 10/2000 Neale
6,139,102 A 10/2000 von Möller
6,152,531 A 11/2000 Deceuninck
6,152,532 A 11/2000 Cosentino
6,158,300 A 12/2000 Klingler
6,227,617 B1 5/2001 von Möller
6,227,618 B1 5/2001 Ligon, Sr. et al.
6,254,186 B1 7/2001 Falzon
6,254,187 B1 7/2001 Schuster, Sr. et al.
6,270,158 B1 8/2001 Hong
6,334,651 B1 1/2002 Duan et al.
6,338,530 B1 1/2002 Gowing
6,364,414 B1 4/2002 Specht
6,402,246 B1 6/2002 Mundell
6,430,801 B1 8/2002 Cosentino
6,296,308 B1 10/2002 Cosentino et al.
6,520,580 B1 2/2003 Hong
6,536,840 B1 3/2003 Schuster, Sr. et al.
6,595,585 B2 7/2003 Mundell
6,616,227 B2 9/2003 Blendea et al.
6,644,740 B2 * 11/2003 Holst et al. ..... 297/284.4
6,652,028 B2 11/2003 McMillen
6,652,029 B2 11/2003 McMillen
6,666,511 B2 12/2003 Schuster et al.
6,676,214 B2 1/2004 McMillen et al.
6,682,144 B2 1/2004 Klingler
6,769,737 B2 * 8/2004 Choi ..... 297/216.14
6,779,844 B2 8/2004 Dosen et al.
6,905,170 B2 6/2005 McMillen et al.
6,908,152 B2 6/2005 McMillen
6,908,153 B2 6/2005 Blendea
6,918,884 B2 7/2005 Knelsen et al.
6,969,115 B2 11/2005 Bourdkane et al.
7,000,986 B2 2/2006 Cruz Fernandes de Pinho et al.
7,090,301 B2 8/2006 Stadlbauer
7,237,847 B2 * 7/2007 Hancock et al. ..... 297/452.56
7,252,335 B2 8/2007 Samain et al.
7,303,231 B2 12/2007 Frank
2003/0085600 A1 5/2003 Mori

FOREIGN PATENT DOCUMENTS

DE 2040794 7/1971
DE 2064419 7/1972
DE 2804703 A1 8/1979
DE 2935352 A1 3/1980
DE 2947472 A1 8/1980
DE 3616155 A1 11/1987
DE 3624396 A1 1/1988
DE 4220995 A1 1/1994
DE 4320105 C1 10/1994
DE 19750116 A1 5/1999
DE 10005215 C1 9/2001
DE 20107424 U1 11/2001
EP 0011396 A1 5/1980
EP 0006840 B1 2/1982
EP 0169293 B1 10/1988
EP 0296938 A1 12/1988
EP 0322535 A1 7/1989

| | | | |
|---|---|---|---|
| EP | 0563709 | A3 | 10/1993 |
| EP | 0485483 | B1 | 1/1994 |
| EP | 0434660 | B1 | 5/1995 |
| EP | 0540481 | B1 | 12/1995 |
| EP | 0662795 | B1 | 12/1996 |
| EP | 0702522 | B1 | 3/1997 |
| EP | 0696251 | B1 | 7/1997 |
| EP | 0746219 | B1 | 11/1998 |
| EP | 0797399 | B1 | 11/1998 |
| EP | 0698360 | B1 | 3/2000 |
| EP | 1046539 | A1 | 10/2000 |
| FR | 2596334 | A1 | 10/1987 |
| GB | 0487420 | | 6/1938 |
| GB | 849798 | | 9/1960 |
| GB | 1423617 | | 2/1976 |
| GB | 2013487 | A | 8/1979 |
| GB | 2059497 | A | 4/1981 |
| GB | 2149654 | A | 6/1985 |
| RU | 587924 | | 2/1978 |
| WO | WO/00/00064 | | 1/2000 |
| WO | WO 03/022626 | | 3/2003 |
| WO | WO 2004/043207 | A2 | 5/2004 |
| WO | WO 2004/043730 | A2 | 5/2004 |

* cited by examiner

CONSTANT PRESSURE RETREATING LUMBAR SYSTEM

CROSS-REFERENCE TO RELATED APPLICATIONS

This application claims priority of provisional application No. 61/066,803 filed on Feb. 22, 2008.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to lumbar support systems for recliner chairs and, more particularly, to a constant pressure lumbar support system.

2. Related Art

In recliner chairs with lumbar support systems, a great many systems use a sinuous wire type of lumbar support. As the chair is placed into a reclining position, the wire may collapse as the weight of the user bears fully on the wire. When the wire collapses, its convex shape relative to the user reverses and the wire may assume a concave shape. This can ruin the lumbar support, and also fails to provide the user with any meaningful support for his or her lumbar region.

SUMMARY OF THE INVENTION

Accordingly, the present invention has been made to solve the above-mentioned problems occurring in the prior art, and it is an object of the present invention to provide a lumbar support system for a recliner chair that can provide meaningful support for a user's lumbar region when the chair is placed into a reclining position.

To achieve the above object, according to the present invention, there is provided a constant pressure lumbar support system that retreats into the seat back when the weight of a user increases from a shift to a reclining position. Due to this retreat, the lumbar support system may maintain a constant supporting position for the lumbar region of a user.

In one aspect of the present invention, there is provided a lumbar support system. The lumbar support system has a lumbar support basket supported by a crossbar. The crossbar is pivotably connected to opposite sides of a seat frame via a pair of connecting members. The lumbar support system also has a bias system for biasing the connecting members to a biased position.

The bias system, having for example springs, further allows a variable retreat into the seat depending on the weight of the user. As the seat is reclined, the weight pressure of the user forces the spring-loaded connecting members, for example two-bar pivots, to pivot into the seat back. As the lumbar system drops backwards into the seat back, the top of the lumbar system may slide at the top. Thus, as the recliner assumes a progressively reclining position, the pressure exerted by the weight of the user will increase, and the lumbar support will extend further into the seat back. Retreating into the seat back, the lumbar support will continue to provide support to the lumbar region of the user.

In a preferred embodiment of the present invention, the lumbar support basket is adjustable. Preferably, the lumbar support system further has a guide wire connected to the seat frame. In a preferred embodiment, at least a portion, preferably a top portion, of the lumbar support basket is slideably connected to the guide wire such that the lumbar support basket can be adjusted by sliding along the guide wire. Preferably, the lumbar support system further has a flexible lumbar top mount for connecting the guide wire to the seat frame in a suspended manner. Preferably, the lumbar support system has a Bowden cable for adjusting the lumbar support basket such that when a tension is applied to the Bowden cable the lumbar support basket can arch into a convex shape facing toward the seat user.

In a preferred embodiment of the present invention, the connecting members are a pair of two-bar links for pivotably connecting the crossbar to opposite sides of the seat frame. Preferably, the lumbar support system has a pair of brackets fixed to the opposite sides of the seat frame. The two-bar links are pivotably connected to the pair of brackets, respectively. Preferably, the bias member is a pair of springs connected between the pair of two-bar links and the pair of brackets, respectively.

In a preferred embodiment, the lumbar support system can have a pair of suspension cables connected between the pair of two-bar links and a seat base of the seat frame, respectively.

In a preferred embodiment, the connecting members are pivotable independently of each other so that one of the two-bar links can pivot to a greater degree than the other does. In other words, when the user is seated leaning to one side, the same side of the lumbar support system retreats into the seat back deeper than the other side thereof.

In another aspect of the present invention, there is provided a reclining chair. The reclining chair has a reclining seat frame, a lumbar support basket, and a crossbar for supporting the lumbar support basket. The crossbar is pivotably connected to opposite sides of the reclining seat frame via a pair of connecting members. The reclining chair also has a bias member for biasing the connecting members to a biased position.

In a preferred embodiment, the lumbar support basket is adjustable. Preferably, the reclining chair has a guide wire connected to the reclining seat frame. A portion, preferably a top portion, of the lumbar support basket is slideably connected to the guide wire. Preferably, the reclining chair has a Bowden cable for adjusting the lumbar support basket.

In a preferred embodiment, the reclining chair has a lumbar top mount for connecting the guide wire to the reclining seat frame in a suspended manner.

In a preferred embodiment, the connecting members are pivotable independently of each other so that one of the two-bar links can pivot to a greater degree than the other does. In other words, when the user is seated leaning to one side, the same side of the lumbar support system retreats into the seat back deeper than the other side thereof.

It should be noted that the lumbar support may be one of different varieties: a two-way power (for example, in-and-out or up-and down motion), four-way power (for example, in-and-out and up-and-down motion), or four-way power with massage.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
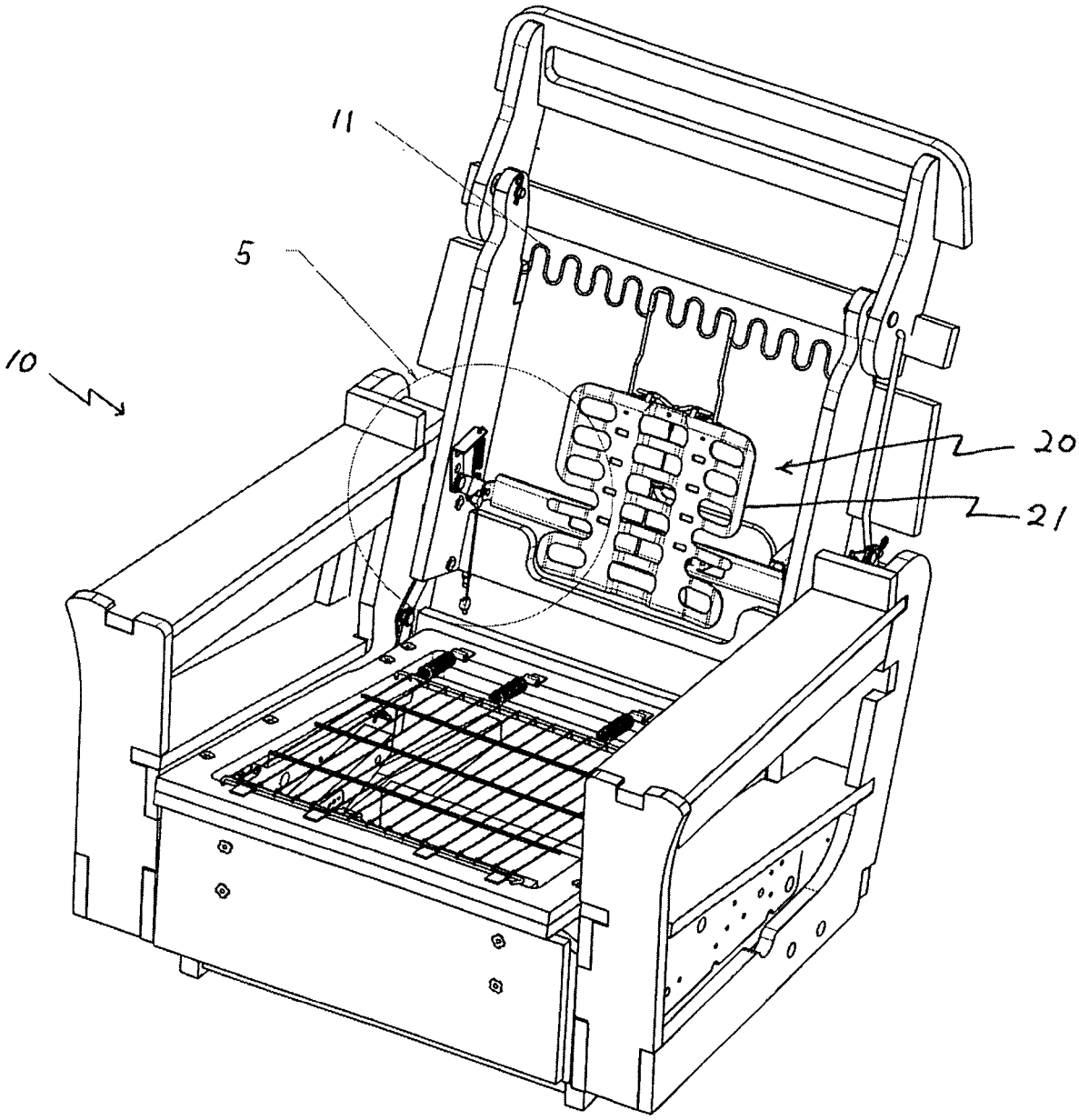
FIG. 1 is a front perspective view of a frame of recliner seat wherein a lumbar support system is installed according to the present invention.
Figure 2:
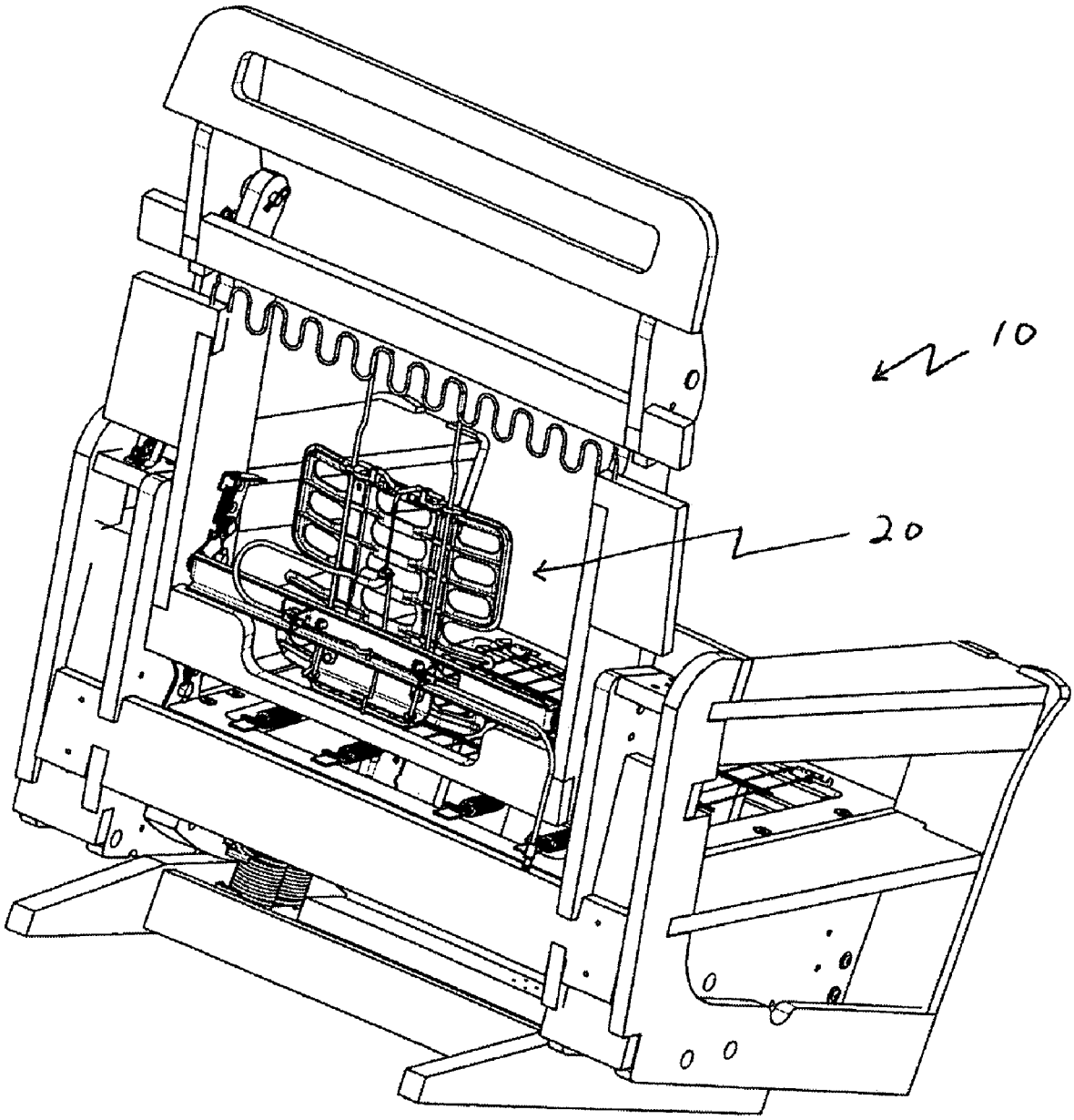
FIG. 2 is a rear perspective view of the frame of recliner seat of FIG. 1.
Figure 3:
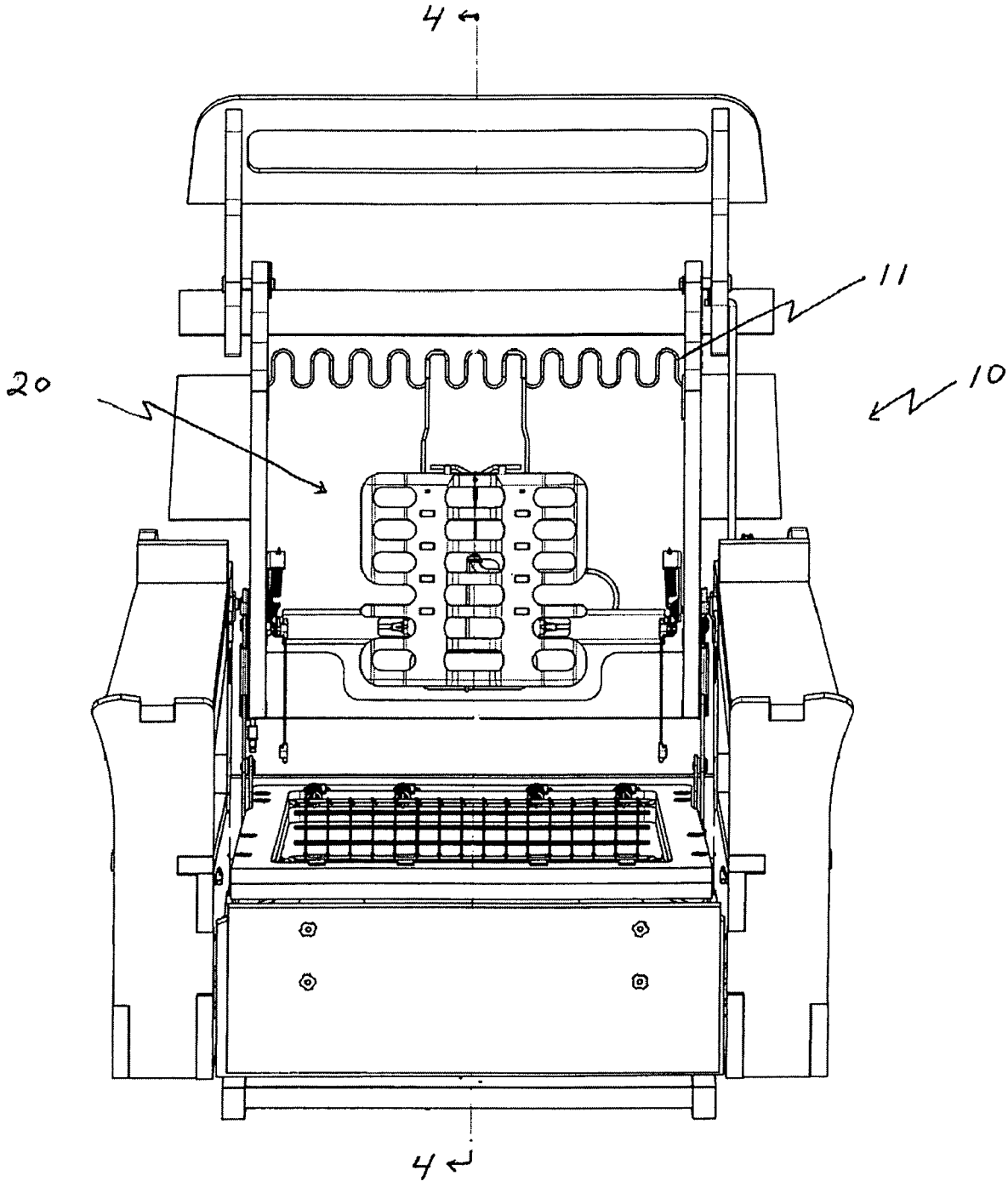
FIG. 3 is a front view of the frame of recliner seat of FIG. 1.
Figure 4:
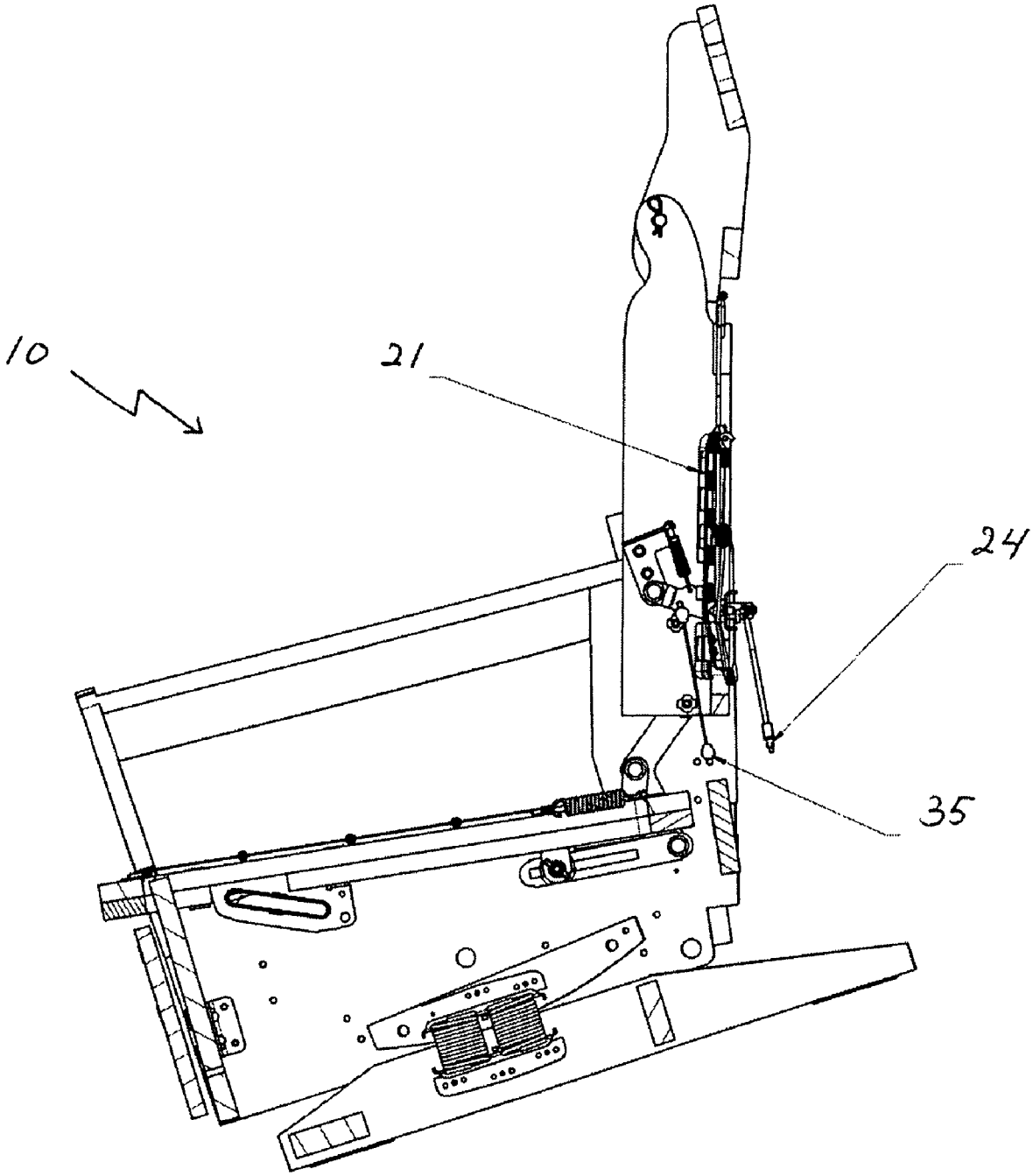
FIG. 4 is a sectional view of the frame of recliner seat taken along the line 3-3 of FIG. 2.
Figure 5:
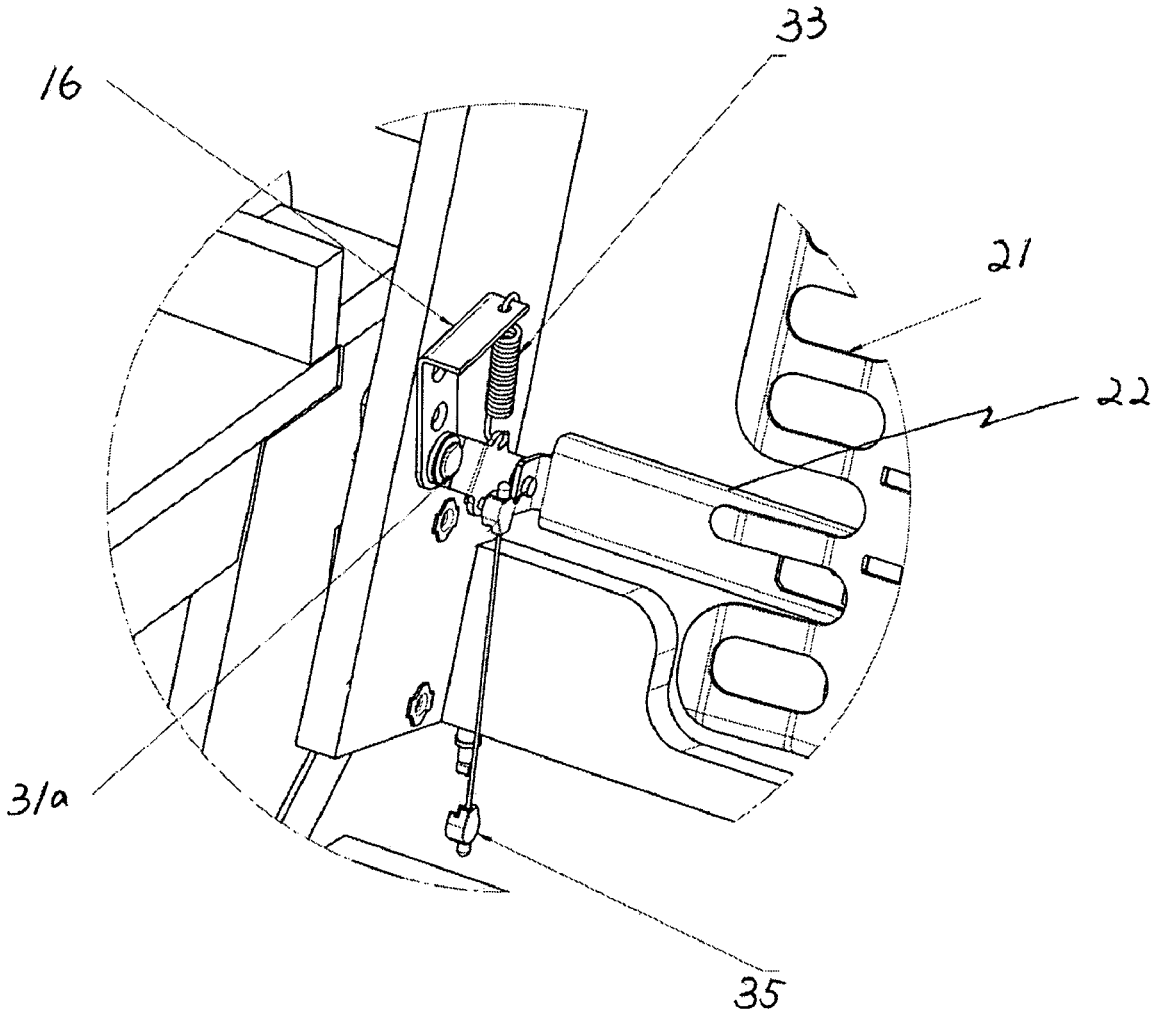
FIG. 5 is a partial, enlarged view of the circle 5 of FIG. 1 showing the lumbar support system installed in the frame of recliner seat according to the present invention.
Figure 6:
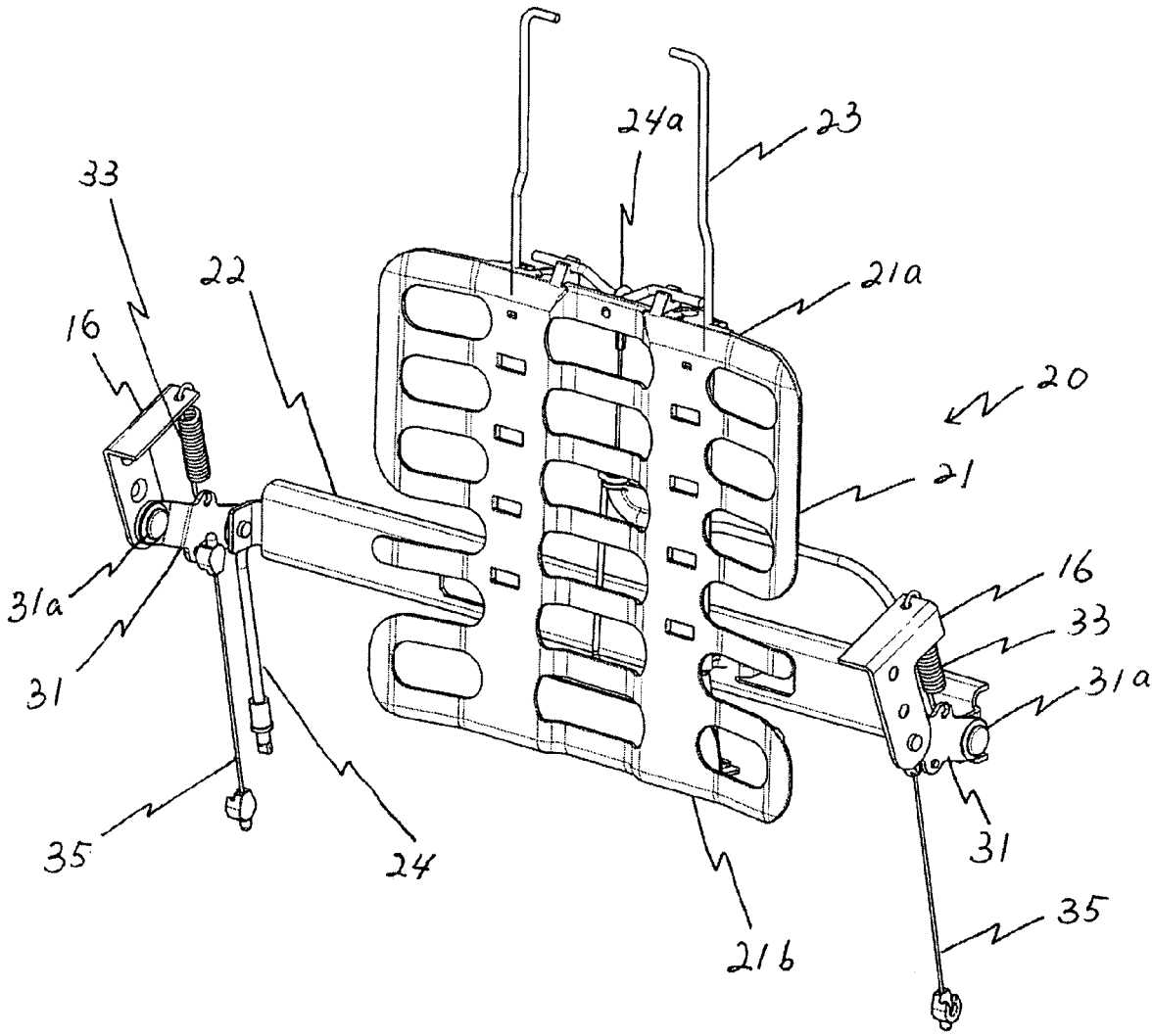
FIG. 6 is a front perspective view of the lumbar support system according to the present invention.
Figure 7:
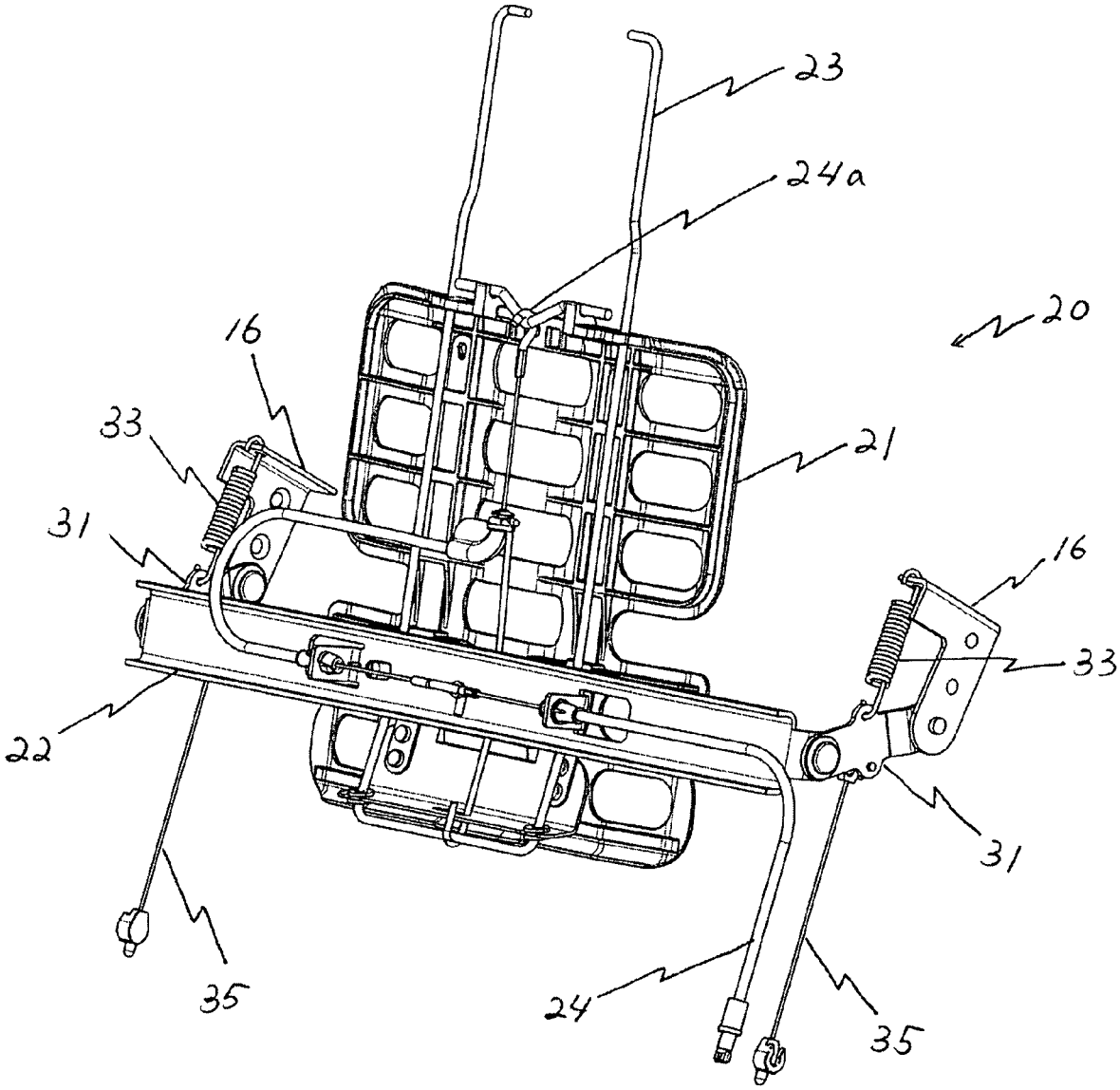
FIG. 7 is a rear perspective view of the lumbar support system of FIG. 6.
Figure 8:
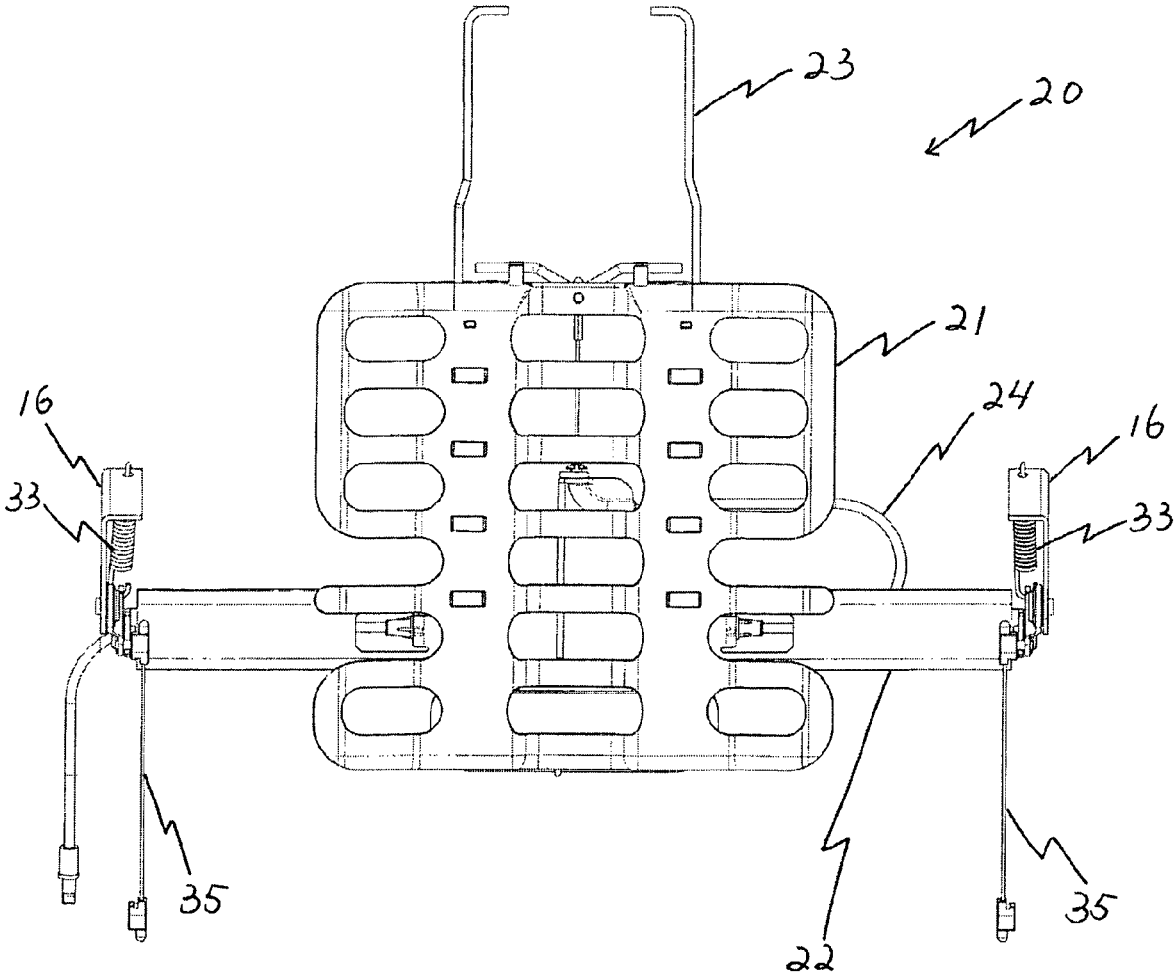
FIG. 8 is a front view of the lumbar support system of FIG. 6.
Figure 9:
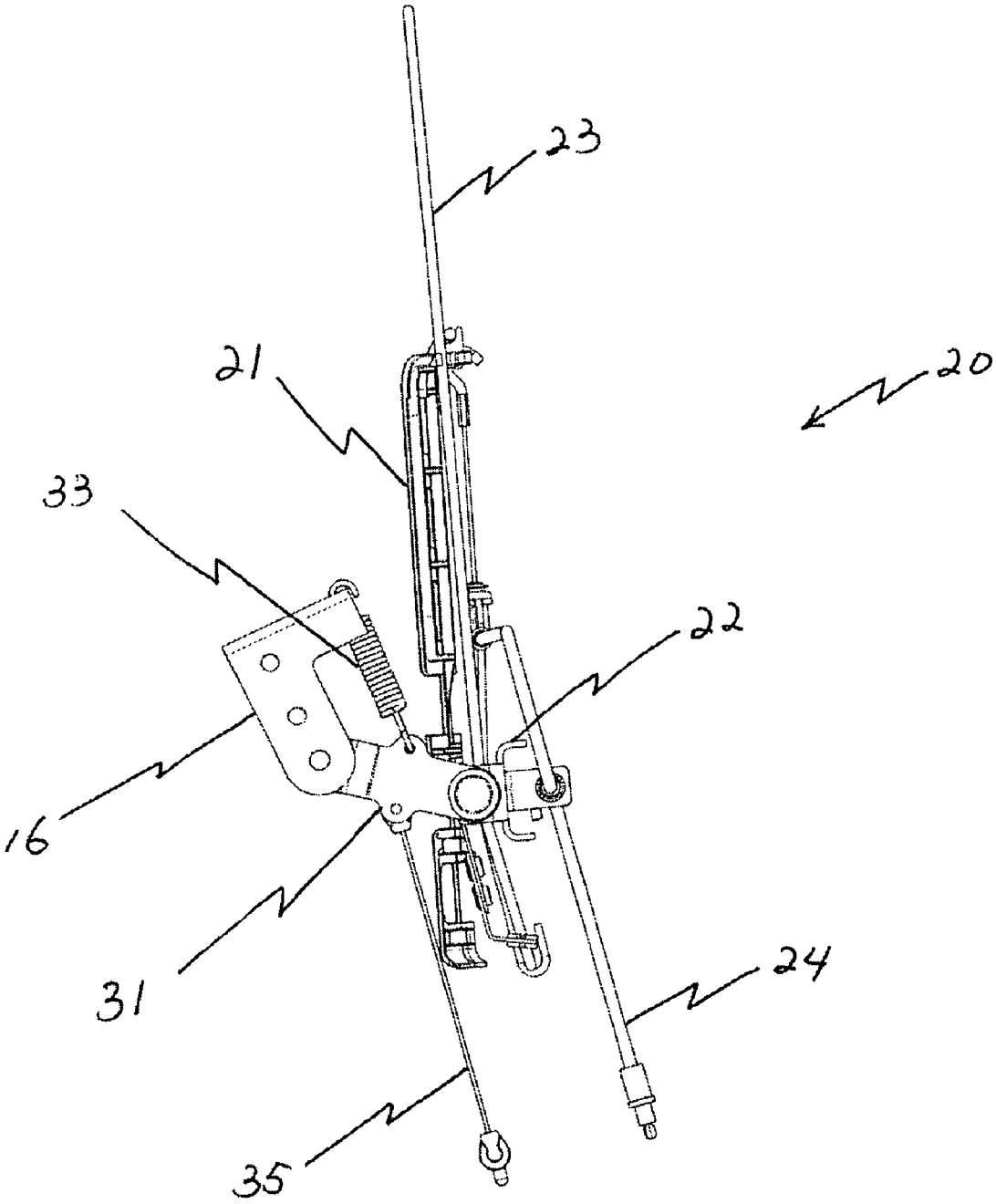
FIG. 9 is a side view of the lumbar support system of FIG. 6.
Figure 10:
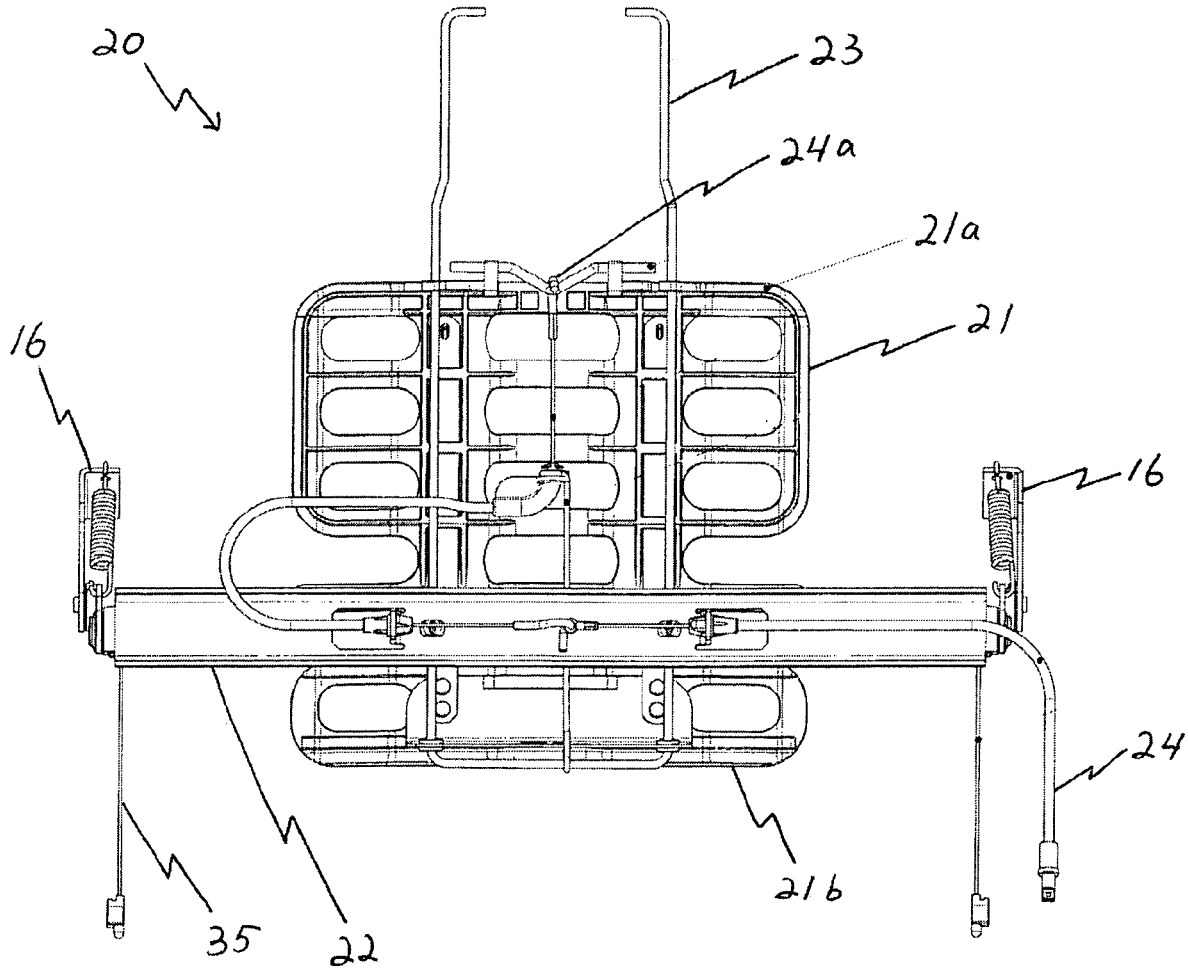
FIG. 10 is a rear view of the lumbar support system of FIG. 6.
Figure 11:
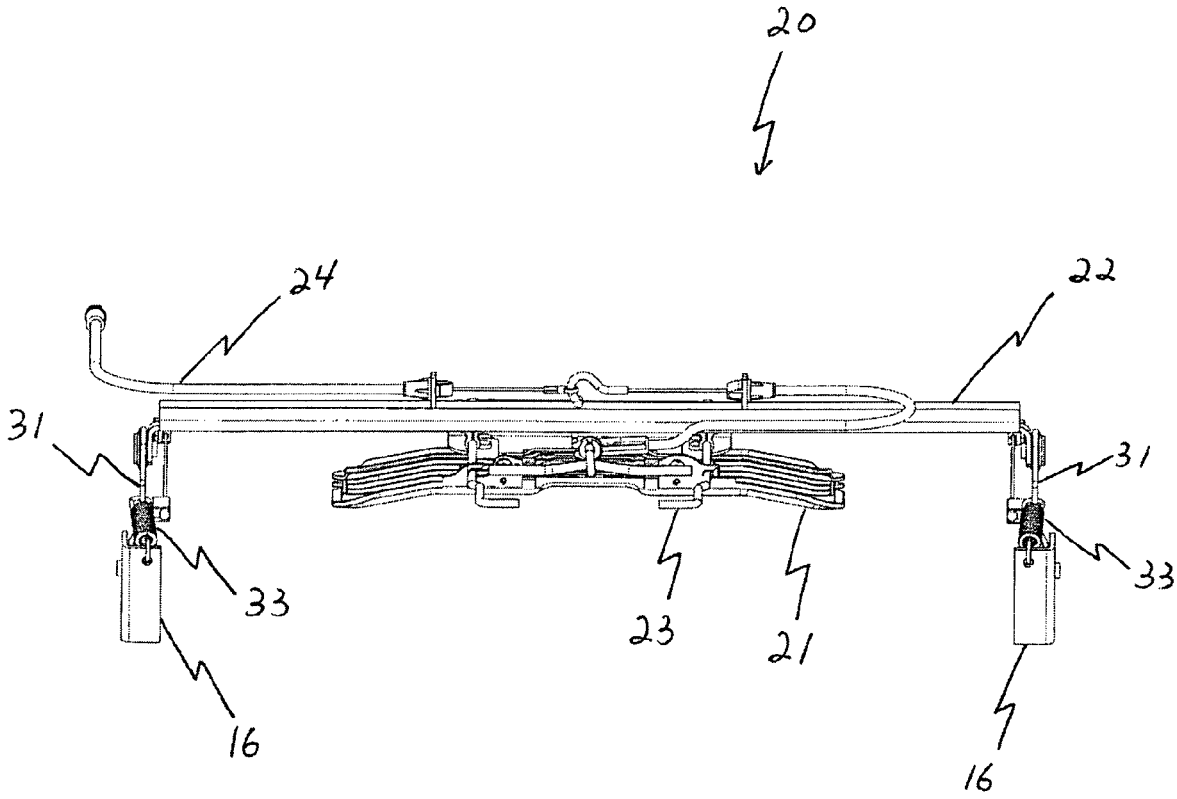
FIG. 11 is a top view of the lumbar support system of FIG. 6.

Shown in FIGS. 1-5 is an example of a frame of recliner seat 10 where a lumbar support system 20 according to the present invention is installed. FIGS. 6-11 illustrate in more details the lumbar support system 20 where the seat frame 10 is omitted.

The lumbar support system 20 has a lumbar support basket 21 for providing support to the lumbar region a user. In the illustrated embodiment, the lumbar support system 20 has a guide wire 23 on to which the lumbar support basket 21 is slideably mounted. The guide wire 23 is connected to the seat frame 10. The guide wire 23 can be connected to the seat frame 10 via an optional sinuous lumbar top mount 11. Preferably, the lumbar support basket 21 is connected to the seat frame 10 in a suspended manner via the guide wire 23 and the optional sinuous lumbar top mount 11.

The lumbar support basket 21 is preferably adjustable. In the illustrated embodiment, the lumbar support system 20 has a Bowden cable assembly 24. One end 24*a* of the Bowden cable assembly 24 is attached to a top portion 21*a* of the lumbar support basket 21. The other end of the Bowden cable assembly 24 is connected to an adjust lever (not shown) that can be located in an armrest portion of the recliner seat. When a tension is applied to the Bowden cable assembly 24 through the adjust lever, the top portion 21*a* of the lumbar support basket 21 is forced to slide along the guide wire 23 downwardly toward a bottom portion 21*b* of the lumbar support basket 21 so that the lumbar support basket 21 can arch into a convex shape facing toward the user so as to provide more support to the lumbar region of the user. This enables the user to adjust the in-out (back-forward) position of the lumbar support basket 21. Additionally or alternatively, the lumbar support system 20 can have up-down adjustment means (not shown) so as to enable the user to activate the lumbar support basket 21 to slide along the guide wire 23 to adjust the up-down position of the lumbar support basket 21.

In the illustrated embodiment, the lumbar support basket 21 is mounted on a crossbar 22, which extends horizontally. Instead of being mounted, the lumbar support basket 21 may simply lie on the crossbar 22 so that the crossbar 22 supports the lumbar support basket 21. In either case, each end of the crossbar 22 is pivotably connected to a pivot 31. In the illustrated embodiment, the pivot 31 is in the form of a two-bar link. Each pivot is also pivotably connected to a bracket 16, which is fixed to the seat frame 10. The pivot 31 can swing relative to the bracket 16 around a pivot axis 31*a*. This enables the crossbar 22 to move between a position relatively close to the user and a position relatively distant from the user.

In the illustrated embodiment, there is a spring 33 connected between the pivot 31 and the bracket 16. The spring 33 allows the pivot 31 to assume a biased position. When the recliner seat is reclined, the weight of the user exerted on the lumbar support basket 21 increases. The weight is translated through the crossbar 22 and the pivot 31 to the spring 33. The spring 33 then deforms, and then the pivot 31 pivots the crossbar 22 and thus the lumbar support basket 21 away from the user. As the lumbar support basket 21 pivots away from the user, the top of the lumbar support basket 21 slides deeper into the seat. The retreating distance of the lumbar support basket 21 into the seat back varies depending on the weight of the user exerted on the lumbar support basket 21. As the recliner chair assumes a progressively reclining position, the pressure exerted on the lumbar support basket 21 also progressively increases, and the lumbar support system 20 continues to provide a reliable lumbar pressure support, while retreating into the seat back away from the user.

It will be appreciated that the retreating distance will also vary depending on the weight of the user. It is presently considered that for a 400 pound person, the lumbar support basket 21 retreats into the seat back up to 100 mm. For a 100 pound person, the lumbar support basket 21 will retreat into the seat back by 10 mm. An optimal level of retreat based on weight may be determined and then implemented by varying the rating of the spring 33.

In a preferred embodiment, the two pivots 31 can pivot independently of each other. In other words, one of the pivots 31 can pivot to a greater degree than the other does. Accordingly, when the user is seated leaning to one side, the same side of the lumbar support basket 21 retreats into the seat back deeper than the other side thereof does.

In the illustrated embodiment, there are also shown two suspension cables 35 that are connected between their respective pivot 31 and a seat base.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A lumbar support system for a reclining chair comprising:

a lumbar support basket, wherein said lumbar support basket is adjustable;

a crossbar for supporting said lumbar support basket;

a pair of connecting members for pivotably connecting said crossbar to opposite sides of a seat frame of the reclining chair;

a bias member for biasing said connecting members to a biased position; and a guide wire connected to the seat frame, wherein at least a portion of said lumbar support basket is slideably connected to said guide wire.

2. The lumbar support system of claim 1, further comprising a lumbar top mount for connecting said guide wire to the seat frame in a suspended manner.

3. The lumbar support system of claim 1, further comprising a Bowden cable for adjusting said lumbar support basket.

4. The lumbar support system of claim 3, wherein said lumbar support basket arches when a tension is applied to said Bowden cable.

5. The lumbar support system of claim 1, wherein said pair of connecting members comprise a pair of pivots in the form of a two-bar link.

6. The lumbar support system of claim 5, further comprising a pair of brackets fixed to the opposite sides of the seat frame, wherein said pair of pivots are pivotably connected to said pair of brackets, respectively.

7. The lumbar support system of claim 6, wherein said bias member comprises a pair of springs connected between said pair of pivots and said pair of brackets, respectively.

8. The lumbar support system of claim 5, further comprising a pair of suspension cables connected between said pair of pivots and a seat base of the seat frame, respectively.

9. The lumbar support system of claim 1, wherein said pair of connecting members are pivotable independently of each other.

10. A reclining chair comprising:

a reclining seat frame;

a lumbar support basket, wherein said lumbar support basket is adjustable;

a crossbar for supporting said lumbar support basket;

a pair of connecting members for pivotably connecting said crossbar to opposite sides of said reclining seat frame;

a bias member for biasing said connecting members to a biased position; and a guide wire connected to said reclining seat frame, wherein at least a portion of said lumbar support basket is slideably connected to said guide wire.

11. The reclining chair of claim 10, further comprising a lumbar top mount for connecting said guide wire to said reclining seat frame in a suspended manner.

12. The reclining chair of claim 10, further comprising a Bowden cable for adjusting said lumbar support basket.

13. The reclining chair of claim 10, wherein said pair of connecting members are pivotable independently of each other.

* * * * *